United States Patent [19]

Trott

[11] Patent Number: 4,518,166

[45] Date of Patent: May 21, 1985

[54] PLAYING COURT AND METHOD OF USE

[76] Inventor: Millard C. Trott, 6637 Seminole, West Chester, Ohio 45069

[21] Appl. No.: 456,450

[22] Filed: Jan. 7, 1983

[51] Int. Cl.[3] ..... A63B 71/04

[52] U.S. Cl. ..... 273/411; 272/3; 273/146; 52/81; 52/DIG. 10

[58] Field of Search ..... 272/3; 273/411, 146; 52/81, DIG. 10, 80

[56] References Cited

U.S. PATENT DOCUMENTS

| | | | |
|---|---|---|---|
| 1,523,615 | 1/1925 | Stern | 273/146 |
| 3,660,952 | 5/1972 | Wilson | 52/81 |
| 3,685,221 | 8/1972 | Mangan | 52/80 |
| 3,722,153 | 3/1973 | Baer | 52/81 |
| 3,758,106 | 9/1973 | Liebig | 273/411 X |

*Primary Examiner*—William H. Grieb

*Attorney, Agent, or Firm*—Wood, Herron & Evans

[57] ABSTRACT

A playing court and a method of using this court to play a game similar to racquetball wherein the playing court has two walls which are alternately used as service walls. The two service walls differ in shape or orientation to provide additional variables for a racquetball-type game. A unique court is described wherein the court is formed in the shape of a truncated pentagonal dodecahedron wherein the first service wall is a modified pentagon having a vertex pointing directly upwardly and a bottom edge joining the floor of the playing court and the second service wall is a regular pentagon having its lowest vertex touching the floor of the playing court and its uppermost edge parallel to the plane of the floor. Unique rules of this game are disclosed along with means to provide additional chance factors using a unique pentagonal dodecahedron die to determine specific parameters of play.

6 Claims, 7 Drawing Figures

PLAYING COURT AND METHOD OF USE

The present invention relates to a game court designed for use in a game in which a ball is bounced off a service wall similar to other games such as squash, racquetball and handball and further relates to a method for using this court.

BACKGROUND OF THE INVENTION

Over the past years, court games, such as racquetball, have become particularly popular. These games are fast and provide a great deal of entertainment. However, they lack one particular feature—variability. Since all the courts are basically cubic, and because the service wall always remains the same throughout the game, there is a high degree of predictability, and certain players lose interest in the game.

Accordingly, it is an object of the present invention to provide a playing court for use in a game in which a ball is repeatedly bounced against the service wall wherein there are more variables in the play of the game. It is particularly an object of this invention to provide a playing court in which more than one service wall is provided.

These objects are obtained by providing a playing court with interior surfaces forming a polyhedron and which includes two service walls, each service wall having a different shape, orientation, or orientation and shape, at least one of the service walls being non-rectangular. This provides a higher degree of variability than can be attained in prior art racquetball type courts.

The preferred invention comprises a playing court having an interior surface which is a modified or truncated pentagonal dodecahedron. With this figure, the service walls are the front and back walls which are parallel to each other and perpendicular to the floor. Further the invention also comprises a method of play using the modified or truncated pentagonal dodecahedron in combination with a pentagonal dodecahedron die to facilitate a court game having unique rules.

Throughout this application, the playing court will be described with respect to a pentagonal dodecahedron. With respect to this means of the description, it is actually the interior surfaces of the playing court which form the polyhedron. Although the drawings appear to show the exterior surface of the playing court, they are actually depicting this interior playing surface of the game court of the present invention.

The playing court of the present invention is a modified pentagonal dodecahedron which, for purposes of description, is formed by truncation of a regular pentagonal dodecahedron 11 along a plane 12 referred to as a plane of truncation which becomes the floor, or bottom surface, of the playing court.

Figure 1:
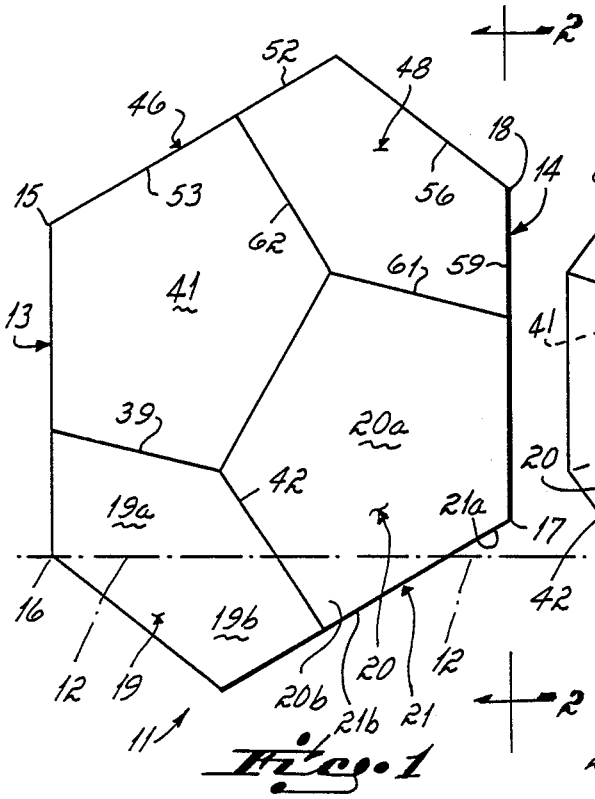
FIG. 1 is a side view of a regular pentagonal dodecahedron showing the plane of truncation used to modify this regular pentagonal dodecahedron to form the court of the present invention.
Figure 2:
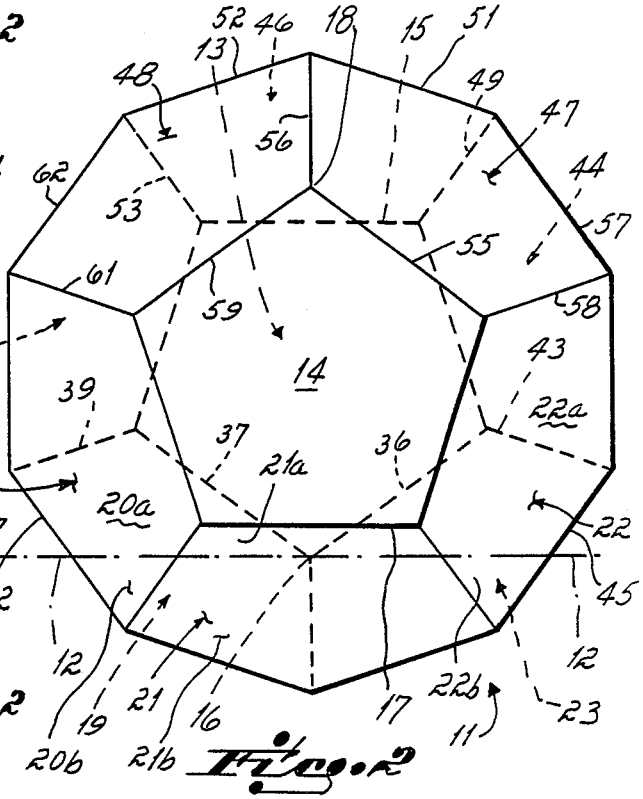
FIG. 2 is an end view, as seen on line 2—2 of FIG. 1, of a regular pentagonal dodecahedron showing the plane of truncation used to modify this regular pentagonal dodecahedron to form the court of the present invention.

In order to properly modify or truncate the regular pentagonal dodecahedron 11 to arrive at the playing surface of the present invention, the dodecahedron 11 is aligned so that a first wall 13 and a second wall 14 which is directly opposite the first wall 13, are parallel to each other and perpendicular to the plane of the earth and perpendicular to the plane of truncation 12 (see FIGS. 1 and 2).

The first wall 13 has a first or upper edge 15 parallel to the plane of the earth and a point or vertex 16 pointing directly downward towards the plane of the earth and touching the plane of truncation 12. The opposite second wall 14 of the regular pentagonal dodecahedron has a bottom edge 17 lying parallel to the plane of the earth and an upper vertex 18 pointing directly upward away from the plane of the earth. The bottom edge 17 lies slightly above the plane of truncation. Walls 13 and 14 are 180° out of phase with each other.

The plane of truncation 12 extends through five lower sides 19, 20, 21, 22 and 23. Each of these lower sides or walls has a section 19*a*, 20*a*, 21*a*, 22*a* and 23*b* above the plane of truncation and sections 19*b*, 20*b*, 21*b*, 22*b* and 23*b* below the plane of truncation. The modified pentagonal dodecahedron which forms the playing court of the present invention does not include these sections 19*b*–23*b* of walls 19–23 which lie below the plane of truncation 12.

Three walls of the now truncated pentagonal dodecahedron are modified in order to provide a completely enclosed playing court. As shown in FIGS. 1 and 2, the bottom edge 17 of the second wall 14 does not extend completely to the plane of truncation 12. Section 21*a* of wall 21 extends from the plane of truncation to edge 17. This section 21*a* is removed, and the bottom of the second wall 14 is extended downwardly until a bottom edge 24 lies on the plane of truncation 12 to form a modified pentagon 25 (see FIG. 4).

Figure 4:
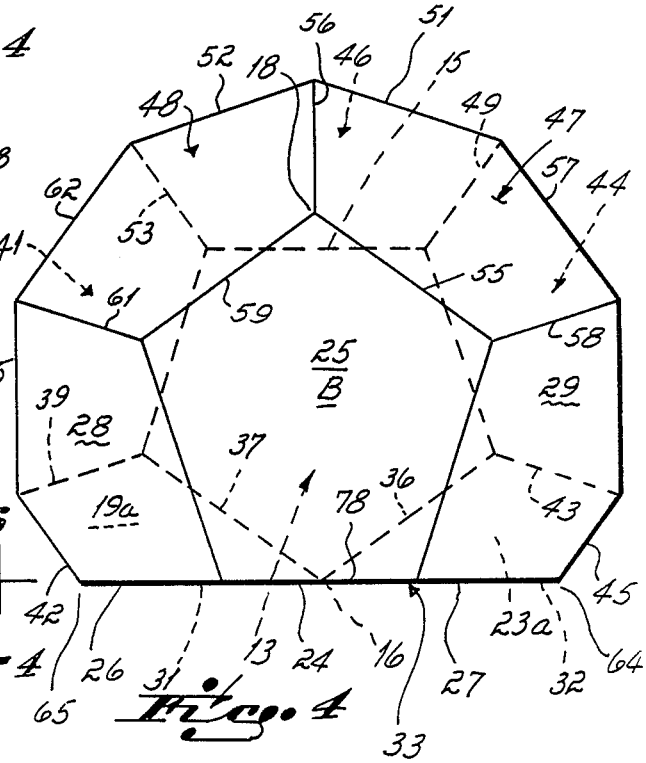
FIG. 4 is an end view of the surfaces of the playing court of the present invention as seen on line 4—4 of FIG. 3.

The two side walls 20*a* and 22*a*, which are immediately adjacent the second wall 14, are modified by providing a bottom edge 26 of side 20 and bottom edge 27 of side 22, which extend along the plane of truncation 12 extending to the side of the now-extended back wall 25, providing modified walls 28 and 29 having pentagonal shapes (see FIG. 4).

Figure 3:
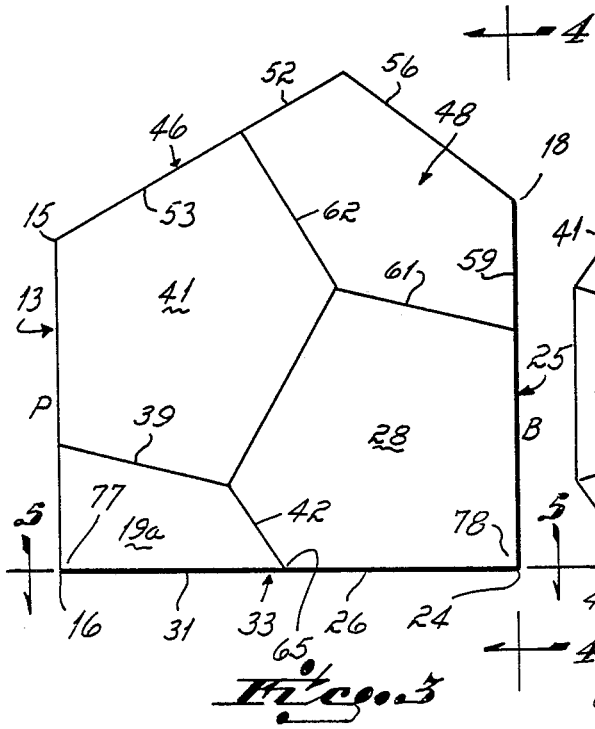
FIG. 3 is a side view of the surfaces of a playing court of the present invention.

In addition, as shown in FIGS. 3 and 4, the modified or truncated pentagonal dodecahedron includes two modified lower side walls adjacent front wall 13 and corresponding to section 19*a* and 23*a*. These walls are quadrangular in shape, each having a bottom edge 31 and 32 lying at the plane of truncation. With the exception of the playing floor of the court, which is the plane of truncation, wall 25 and side walls 19*a*, 23*a*, 28 and 29, all the sides of the playing court are regular pentagons.

These are the differences between a regular pentagonal dodecahedron as shown in FIGS. 1 and 2 and the playing surface of the present invention as shown in FIGS. 3 and 4. The court will now be described in more detail and with reference to the function of particular walls of this court. In this description, any numbered sides or edges of the dodecahedron shown in FIGS. 1 and 2 which have not been modified to form the playing court of FIGS. 3, 4 and 5 retain their original numbers in FIGS. 3, 4 and 5. For example, vertex 18 of FIGS. 1 and 2 is also vertex 18 of FIGS. 3 and 4.

Figure 5:
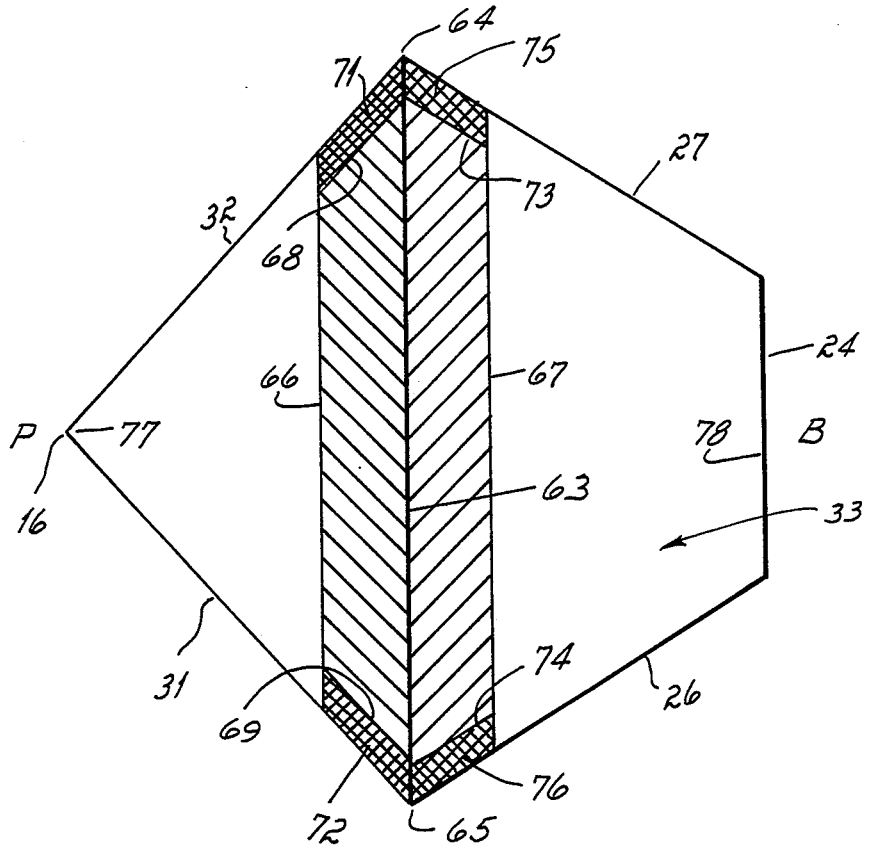
FIG. 5 is a plane view of the playing floor as seen on line 5—5 of FIG. 3.

Referring more particularly to FIGS. 3, 4 and 5, the modified pentagonal dodecahedral playing court surface has a planar, generally pentagonal floor 33 which lies at the plane of truncation (see FIG. 5). The floor is defined by bottom edges 26, 24, 27, 32 and 31 of walls 28, 25, 29, 23*a* and 19*a*, respectively.

The playing court, or surface, includes a first service wall which is referred to in the description of the playing method of the present game as the "P wall." This is wall 13. The first service wall 13 is a regular pentagon and is perpendicular to the floor 33. The first service wall 13 includes first vertex 16 formed by a first edge 36 and a second edge 37. Edge 36 is an edge of quadragonal wall 23*a* and edge 37 is an edge of quadragonal wall 19*a*. The first service wall includes the upper third edge 15, which is directly opposite the first vertex 16 and parallel to the plane of the floor 33.

The playing surface further includes a second service wall directly opposite the first service wall 13, and is the modified wall 25. This will also be referred to as the "B wall". The second service wall 25 is a generally pentagonal planar surface perpendicular to the floor 33. It includes first lower edge 24 which is an edge of the floor 33 and the first vertex 18 which is immediately opposite the edge 24 and points directly upward away from the floor 33.

The playing court further includes the two generally quadrangular planar walls 19*a* and 23*a*. These walls are each referred to as a DO wall in the description of the playing method of this present game.

DO wall 19*a* includes a first side which is also edge 31 of the floor 33, and a second edge which is edge 37 of the first service wall 13. A third edge 39 of DO wall 19*a* adjoins an edge of an upper forward playing wall 41 which is a regular pentagon. A fourth edge 42 of DO wall 19*a* is also a lower edge of lower wall 28.

DO wall 23*a* is a mirror image of DO wall 19*a* with a first edge which is also edge 32 of floor 33, a second edge which is the second edge 36 of first service wall 13. DO wall 23*a* further includes an upper edge 43 which is contiguous with an edge of an upper forward playing wall 44 which is a mirror image of upper wall 41. A fourth edge 45 of DO wall 23*a* lies opposite edge 42 and is contiguous with an edge of lower wall 29.

Thus, the playing court has two service walls 13 and 25 and six side walls, i.e., upper walls 41 and 44, lower walls 28 and 29, and DO walls 19*a* and 23*a*.

The playing court includes three regular pentagonal ceiling walls 46, 47 and 48. Ceiling wall 46 includes a lower edge which is contiguous with upper edge 15 of P service wall 13. The remaining four edges, 49, 51, 52 and 53 which define ceiling wall 46, adjoin and form edges of the upper wall 44, ceiling wall 47, ceiling wall 48, and upper forward playing wall 41, respectively.

Ceiling wall 47 includes an edge 55 which is an upper edge of the B service wall 25. A second edge 56 forms an edge of ceiling wall 48. A third edge is edge 51 of said ceiling wall 46, and a fourth edge 57 is an upper edge of said upper wall 44. Fifth edge 58 is a side of the lower wall 29.

Ceiling wall 48 also includes five edges. The first edge 59 is an upper edge of said second service wall 25. A second edge 61 is an upper edge of said lower wall 28. A third edge 62 is an upper edge of said upper forward wall 41. A fourth edge is edge 52 of wall 48. A fifth edge 56 is an edge of the ceiling wall 47.

Preferably, the floor 33 includes a series of painted lines to indicate service lines and short lines and service boxes. For example, as shown in FIG. 5, the floor includes a short line 63 extending from a second vertex 64 of the floor 33 across to a third vertex 65 of the floor, the line being parallel to the plane of service walls 13 and 25. In addition, two service/receiving lines 66 and 67 (hereinafter S/R lines) lie about 18 inches on either side of the short line 63 and parallel to the short line 63. The S/R lines extend completely across the court.

Two additional lines 68 and 69 extend from short line 63 to S/R line 66 parallel to edges 32 and 31, respectively. These lines, together with edges 32 and 31 and S/R line 66 and short line 63, define two P service boxes 71 and 72. Two additional lines 73 and 74 extend from short line 63 to S/R line 67 parallel to edges 27 and 26, respectively. These lines, together with edges 27 and 26, short line 63 and S/R line 67, define two B service boxes 75 and 76.

Only the playing surface of the court has been described. The court should be constructed with materials typically used for handball or racquetball courts which comprise a variety of different surfaces, such as wood, hard plastics and the like. Further, the door to permit entrance into the court is not described. It would be within the knowledge of one of ordinary skill in the art to construct a suitable door which would lie flush with a playing surface. Preferably, the door should not be at either of the service walls and preferably, should be located in one of the lower side walls 28 or 29.

The exact dimensions of each surface is not provided. The size of the court can be increased or decreased depending upon the type of game played. For example, if a harder, less active ball is used, and a hand is used to strike the ball, the playing area should be smaller. Where a more active ball is used or more force is provided by using a racquet, such as a racquetball racquet or a squash racquet, the playing surface would have to be larger. A suitable sized court could be defined from a pentagonal dodecahedron having edges 15 to 17 feet in length.

The playing court, as described, is a twelve-sided playing surface that has the first pentagonal service wall 13 and second pentagonal service wall 25 which are parallel to each other and 180° out of phase. Further, since the first service wall is a regular pentagonal surface and the second service wall is a modified pentagonal surface, these service walls are both differently shaped polygonal planar surfaces and are oriented differently relative to the floor.

There are nine additional surfaces or walls, a DO wall 19*a* and DO wall 23*a*, both of which are quadrangular and are connected to P service wall 13 at edges 37 and 36, respectively. Upper forward walls 41 and 44, and three ceiling walls 46, 47 and 48 are regular pentagons. Lower walls 28 and 29 are modified pentagons. As described, these surfaces, together with the floor, all join together to form a polyhedral playing surface, and substantially enclose this court. Since the service walls are of different shape, different size and out-of-phase, a game can be played in which the service wall alternates or changes, thus changing the complexity of the game.

Die

Figure 6:
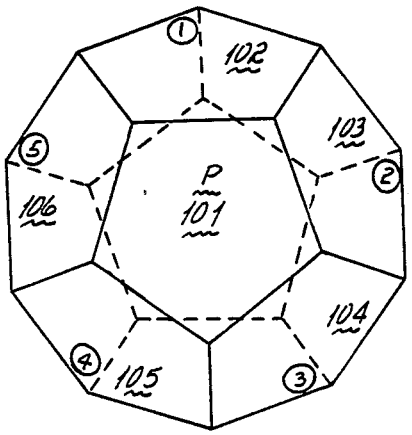
FIG. 6 is an overhead view of a pentagonal dodecahedron die.
Figure 7:
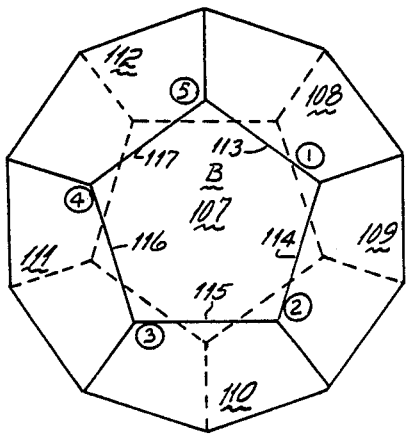
FIG. 7 is a bottom view of the pentagonal dodecahedron die of FIG. 6.

The playing court, as described, is preferably used in combination with a particular die (see FIGS. 6 and 7), specifically a die 100 having a configuration of a pentagonal dodecahedron, hereinafter referred to as a dodecadie. The dodecadie 100 includes a first pentagonal surface 101 which has some distinguishing indicia, for example, a particular color, such as green, and for purposes of this specification, will be referred to as a "P side". The dodecadie further includes five sides, 102, 103, 104, 105, and 106 which adjoin the P side 101. Each of these sides includes a numerical indicia from 1–5 located near a lower vertex of each pentagonal surface as shown in FIG. 6. For purposes of description, these numbers 1–5 are encircled for clarity to distinguish them from figure and descriptive numbers.

The dodecadie includes a seventh side 107 which is directly opposite the "P side" 101 and also bears an indicia distinguishing it from the 'P side', such as coloration, for example, red. For purposes of description, this will be referred to as the "B side". The B side 107 has five adjoining pentagonal surfaces 108, 109, 110, 111, and 112. Each of these pentagonal surfaces 108–112 has an edge 113, 114, 115, 116 and 117 common to B side 107. Each surface 108–112 includes a numerical indicia from 1–5 located on the die face near these common edges 113–117. This indicia is indicated on FIG. 7 by a number which is encircled for clarity to distinguish it from the other numbers on the drawing.

Thus, the dodecadie includes two surfaces, B side 107 and P side 101, bearing a distinguishing indicia and which are parallel to each other and 180° out of phase. The dodecadie further includes five pentagonal surfaces 102–106 which adjoin the P side and five additional surfaces 108–112 which adjoin the B side.

In addition to the die, the court is preferably used with a ball which can vary depending on the desired characteristics of the game, and is preferably a racquetball. Further, the court is used with a racquet. Again, depending upon the desired characteristics, different racquets can be used. The racquet can be a racquetball racquet, a squash racquet, or a wooden paddle or the court can be used without a racquet using the hand as a racquet as in handball. Neither the ball nor the racquet are particularly described since they can be varied depending upon the particular desired characteristics of the game.

There are a variety of methods of using the court previously described. However, there are three basic steps in any variation. First, the ball will be hit by a first of two opposing players or sides against one of the service walls. Preferably, the first player is standing in a designated service box. The ball must next be hit by a second opposing player or side to the same service wall before the ball bounces on the floor twice. The opposing players or sides alternate returning the ball to this service wall. A player's or side's failure to do so causes that player's or side's opponent to earn a point, to gain the serve or both. Secondly, the service wall will change during the course of the game. Thirdly, the game will end when one player or side scores at least a preset number of points. Generally, that player or side must score the preset number of points and have scored at least two more points than the opposing side or player to win.

As is discussed below, the preferred method of using the court of the present invention is in combination with the dodecadie 100 according to a unique set of rules.

The dodecadie is useful both to determine which service wall will be initially used as the starting service wall, and when the service walls are changed so that the alternate or finishing service wall is used to finish up the game.

For example, if a game were to go to 21 points, the points could be broken up into five sets, (a), (b), (c), (d) and (e) (see Table 1), the first set (a) being the first five points, the second set (b) being the second five points, the third set (c) being the third five points, the fourth set (d) being the fourth five points, and the fifth set (e) being the 21st point, and any exceeding that to break a tie. As shown in Table 2 below, these sets can be broken up into five groups where different sets of points are played against designated service walls, either the starting service wall or the finishing service wall.

TABLE 1

| Set | Point |
|---|---|
| a | 1–5 |
| b | 6–10 |
| c | 11–15 |
| d | 16–20 |
| e | 21+ |

TABLE 2

| Group | Sets Played Against Starting Service Wall | Sets Played Against Finishing Service Wall |
|---|---|---|
| I | a | b + c + d + e |
| II | a + b | c + d + e |
| III | a + b + c | d + e |
| IV | a + b + c + d | e |
| V | a + b + c + d + e | |

In Group I, the first five points, set (a), are served against the starting service wall and the remaining points, sets (b), (c), (d) and (e), are served against the second or finishing service wall. In Group II, the first two sets, (a) and (b), i.e., points 1–10, are served against the starting service wall and remaining against the finishing service wall, and so on down to the fifth group wherein all points are served against the starting surface wall and none against the finishing service wall.

The roll of the die determines which group is to be played in a particular game. When the die is rolled, if a numbered face appears, that number would indicate the group selected. For example, if the uppermost die face was marked with a "four", the first 20 points would be served against the starting service wall and any points above 20 would be served against the finishing service wall.

The die is also useful to determine which service wall, i.e., the B wall or the P wall, is the starting service wall and which wall is the finishing service wall. As described previously, the one set of die faces 102–106 have an edge common with the "P side" 101 of the dodecadie, and are marked with numerical indicia 1–5 near a vertex of the pentagonal die face. A second set of die faces 108–112 have an edge common with the B side 107 of the dodecadie and are marked with numerical indicia 1–5 near a base line 113–117 of the pentagonal die faces. After the die is rolled, if the uppermost die face is the P side 101 or a side bordering the P side, the P wall serves as a starting service wall. If the B side 107 or a die face bordering the B side is the uppermost face, the starting service wall will be the B wall. Thus, this dodecadie provides a unique method of determining the sequence of service.

If a die face, which is either the P side 101 or B side 107 appears after a roll of the die, this can be used to determine which wall will be the starting service wall. The opponent having won the last game could then choose which group of points to play. If the first game is being played, a second roll of the die or a flip of a coin could determine who chooses the group of points to play.

There are a number of other variations which can be thrown in due to the unique structure of this court in addition to the changing of the service wall. For example, special points could be created such as a "pentapoint" where the ball is bounced off the P side and hits the floor twice prior to hitting any of the six side walls or three ceiling walls. In a more complex game, the DO walls 19*a* and 23*a* can be included as part of the floor. This would speed the game and force the players to move up on the DO walls to return the ball. Since there are more complex shots that can be made, different point values can be given for different shots.

It is apparent from the above description that the unique playing court of the present invention, together with the unique dodecadie, provides a game which is substantially more variable than racquetball, squash or handball, and yet simple enough for someone to pick up quite quickly.

Of course, other polyhedral playing courts could be designed with two different service walls where at least one service wall is non-rectangular. For example, a court can be designed with one rectangular service wall and one triangular service wall. This court could then be used according to the previously described method.

Accordingly, having thus described my invention, I claim:

1. A playing court to be used by bouncing a ball off service walls of said court comprising a truncated pentagonal dodecahedron said dodecahedron having:

a first service wall;

a second service wall;

a floor;

a plurality of side walls said walls and said floor connected together to form a polyhedral playing surface;

wherein said first service wall and said second service wall are parallel to each other and perpendicular to said floor;

said first service wall comprising a pentagon having a lower vertex said lower vertex contacting said floor; and said second service wall comprising a pentagon having a bottom edge said bottom edge adjoining said floor.

2. The playing court claimed in claim 1 wherein said first service wall is a regular pentagon and said second service wall is a modified pentagon.

3. The playing court claimed in claim 2 further comprising:

three ceiling walls each comprising a pentagon;

six side walls, a first and a second quadragonal side wall, and a third, a fourth, and a sixth pentagonal side walls.

4. A method of playing a game using a court having a floor, two service walls and a plurality of side walls said service walls each comprising different polygonal planar surfaces at least one of said surfaces being non-rectangular; and a resilient ball;

wherein initially two opposing sides alternately attempt to propel said ball against a first of said service walls before said ball strikes said floor twice and continuing until one opposing side is unable to do so thereby scoring a point for the other opposing side; and subsequently wherein said two opposing sides alternately attempt to propel said ball against a second of said service walls before said ball strikes said court twice and continuing until one opposing side is unable to do so thereby scoring a point for the other opposing side.

5. The method claimed in claim 4 wherein said two opposing sides define which service wall is said first of said service walls by rolling a pentagonal dodecahedron die having a first die face said first die face having indicia indicating one of said two service walls and a second die face said second die face having indicia indicating the remaining service wall said first die face being bordered by five pentagonal die faces each having a numerical indicia; said second die face being bordered by five pentagonal die faces each having a numerical indicia;

wherein the first service wall is defined by an uppermost die face appearing after said die is rolled, said one service wall being said first of said service walls when said first die face or any of said die faces bordering said first die face is the uppermost die face and said remaining service wall being said first of said service walls when said second die face or any of said die faces bordering said second die face is the uppermost die face.

6. The method claimed in claim 4 wherein a preselected number of points must be scored to win the game wherein a first group of said points must be served against said initially used service wall and the remaining points must be served against said alternate service wall wherein the appearance of a numerical indicia on the upper face of said die after rolling said die determines the number of points in said first group of points.

* * * * *

UNITED STATES PATENT AND TRADEMARK OFFICE

CERTIFICATE OF CORRECTION

PATENT NO. : 4,518,166

DATED : May 21, 1985

INVENTOR(S) : Millard C. Trott

It is certified that error appears in the above-identified patent and that said Letters Patent is hereby corrected as shown below:

Column 2 line 30 "23b" should be --23a--.

Column 8, line 11 after "a fourth" insert --a fifth--.

Signed and Sealed this

*Eighth* Day of *October 1985*

[SEAL]

*Attest:*

*Attesting Officer*

DONALD J. QUIGG

*Commissioner of Patents and Trademarks—Designate*